US007217150B2

(12) United States Patent
Lekic et al.

(10) Patent No.: US 7,217,150 B2
(45) Date of Patent: May 15, 2007

(54) CONNECTOR ARRANGEMENT WITH STAGGERED MATING

(75) Inventors: Mario Lekic, Zagreb (HR); Dragutin Vida, Zagreb (HR); Harald Michael Lutsch, Weiterstadt (DE)

(73) Assignee: Yazaki Europe Ltd., Hertfordshire (GB)

( * ) Notice: Subject to any disclaimer, the term of this patent is extended or adjusted under 35 U.S.C. 154(b) by 0 days.

(21) Appl. No.: 11/246,606

(22) Filed: Oct. 11, 2005

(65) Prior Publication Data

US 2006/0110957 A1 May 25, 2006

(30) Foreign Application Priority Data

Nov. 25, 2004 (DE) ..... 10 2004 057 093

(51) Int. Cl.
*H01R 13/627* (2006.01)

(52) U.S. Cl. ..... 439/352; 439/924.1

(58) Field of Classification Search ..... 439/352, 439/924.1, 924.2

See application file for complete search history.

(56) References Cited

U.S. PATENT DOCUMENTS

| | | | | |
|---|---|---|---|---|
| 5,144,189 | A * | 9/1992 | Van Heeswijk et al. | 313/51 |
| 5,183,410 | A | 2/1993 | Inaba et al. | |
| 5,727,969 | A * | 3/1998 | Yamanashi | 439/594 |
| 6,325,648 | B1 * | 12/2001 | Bilezikjian et al. | 439/157 |
| 6,648,669 | B1 * | 11/2003 | Kim et al. | 439/357 |
| 7,108,566 | B2 * | 9/2006 | Kressmann et al. | 439/701 |
| 2002/0127901 | A1 | 9/2002 | Saka et al. | |

FOREIGN PATENT DOCUMENTS

| | | |
|---|---|---|
| CA | 2 498 380 A1 | 4/2004 |
| DE | 33 37 686 C1 | 2/1985 |
| DE | 38 83 564 T2 | 3/1994 |
| DE | 197 14 459 A1 | 10/1998 |
| DE | 100 12 324 A1 | 10/2001 |
| DE | 102 08 750 A1 | 11/2002 |
| DE | 102 42 074 B3 | 5/2004 |

* cited by examiner

*Primary Examiner*—Neil Abrams
(74) *Attorney, Agent, or Firm*—Sughrue Mion, PLLC

(57) ABSTRACT

An improved electrical connector. The connector includes a first connector (1) having a housing (5) for receiving first contact elements (9) and a slider (19) slidably disposed on the housing (5) for receiving second contact elements (30); a second connector (3) for receiving first counter contact elements (32) and second counter contact elements (39); and a retainer (20, 36) which allows displacement of the slider (19) such that the second contact elements (30) secured thereto contact the second counter contact elements (39) only when the first and second connectors are completely connected together by a locking device. During mating the first contact elements (9) and first connector contact elements (32) become fully engaged, but no current flow occurs. At this stage, springs (28) act to move the slider (19) forwardly to cause second contact elements (30) which move with the slider to engage second counter contact elements (39) to switch on current to contact elements (9, 32) and to block release of lock arm (10).

10 Claims, 7 Drawing Sheets

CONNECTOR ARRANGEMENT WITH STAGGERED MATING

BACKGROUND OF THE INVENTION

The invention relates to a connector arrangement with a first connector and a second connector, which, respectively, accommodate first contact elements or first counter contact elements, respectively, which are connected to each other, when the first and second connectors are connected to each other. The first connector has a housing with a slider displaceable along a longitudinal axis thereon and which can be displaced into a position representing the completely connected condition, after the first and second connectors have taken up a position, representing the completely connected condition, relative to each other.

Such a connector arrangement is described in DE 100 12 324 A1. One of the two connectors forming the connector arrangement has elastic arms with thickened free ends. The second connector has a sleeve portion, having a groove, in which the thickened portions attached on the elastic arms can engage. So that the two connectors cannot be separated from each other, when pulling forces act on the connected connectors, a slider in form of a sliding sleeve is arranged to one of the two connectors, which is pushed by a spring into an advanced position. When connecting the two connectors, the sliding sleeve comes with its end face arranged towards the other connector to abut the thickenings on the elastic arms and is held stationary, as the elastic arms slide on the sleeve portion of the connector, to which the sliding sleeve is arranged, and can, thus, not move inwardly. Thus, during connecting the two connectors, the sliding sleeve is held stationary starting from the advanced first position relative to the mating connector and, thus, when connecting relative to the first connector, is displaced into a second position. As soon as the two connectors have reached their completely connected position, the thickenings on the elastic arms can move radially inwards into the groove of the sleeve portion. The sliding sleeve is returned by means of the force of the spring acting thereon into its first position, so that a sleeve-like locking portion arranged thereto, can get over the thickenings and prevents these from moving radially outwards. This is achieved, even when pulling forces act on the two connectors. The above mentioned locking means arranged to the two connectors, are, therefore, represented by the sliding sleeve in connection with the groove in the corresponding connector and the elastic arms with the thickenings on the free ends, which are arranged to the second connector.

DE 197 14 459 A1 describes a connector arrangement with a first connector, having a housing, having a first end and a second end and forming a first receptacle for first contact elements. The housing, further, has first locking means in the form of engagement recesses.

The connector arrangement comprises further a second connector, forming a receptacle for first counter contact elements, which are to be connected to the first contact elements, while connecting the two connectors. The second connector comprises, further, second locking means, which are provided in the form of locking arms and hooks formed on their free ends. These engage in the first locking means in form of recesses, when the two connectors are completely connected to each other. Furthermore, to the first connector a slider is arranged, which is moved by a spring into an advanced position. This slider, as long as the two connectors are not completely connected to each other, is retained by the retaining arms of the other connector, so that it starting from a first position is displaced against the force of the spring into a second position on the first connector. As soon as the retaining arms have reached the recesses, the slider with a locking projection enters between the two locking arms and can retain these against exiting from the recesses when pulling at one of the connectors.

The same principal, as the above mentioned, is also disclosed in DE 102 42 074 B3.

U.S. Pat. No. 5,183,410 describes a connector arrangement with a first connector and a second connector, wherein to the first connector, additionally, a slider is arranged, which is urged by a spring into an advanced position. The first connector has, furthermore, first locking means in form of a projection. The second connector has a locking arm, which is elastic and has a locking hook, which in the completely connected condition engages behind the locking projection of the first connector. As long as the two connectors are not completely connected to each other, the slider, acted upon by a spring, acts in the pushing out direction onto the second connector, so that, as long as no complete connection and contact of the respective contact elements is achieved, the two connectors are pushed away from each other.

In a similar manner DE 102 08 750 A1 discloses a connector arrangement, in which also, as long as the two connectors are not completely connected to each other and the locking means of the two connectors are not completely engaged with each other, spring means, which are pre-tensioned during the connecting procedure, are active and push the two connectors away from each other.

DE 100 12 324 A1 relates to a connector arrangement with a first connector, carrying a contact retaining element, retained pre-tensioned in an initial locking position by a spring and accommodating contact elements. A second connector is provided, having a counter contact element. The two connectors are locked to each other by means of locking means in the connected condition. In this case, a free motion is provided, so that, when further displacing the two towards each other, the contact retaining element is released from its initial locking position and the spring means become active and, thus, the contacts, connected to the contact retaining element, are pushed further in connection direction and come to contact the counter contact elements of the second connector.

DE 38 83 564 T2 (U.S. Pat. No. 5,144,189) describes a head light unit with a connector arrangement for releasably connecting a lamp, having a lamp base with two flat electrical connection contacts extending parallel to a longitudinal axis to current carrying conductors. This connector comprises a sleeve-like adaptor, which can be connected in bayonet-like manner to support means in form of an attachment ring, attached on the reflector. Into the sleeve-like adaptor a plug-in device can be axially inserted, which is connected to the cables (wires) of a current supply for the lamp and which device has female connectors, which interact with the connection contacts of the lamp. The lamp is held by the adaptor on the reflector. When assembling the head light unit the electric lamp is inserted through an opening in the reflector, so that the opening accommodates the lamp base. The means accommodating the lamp base are part of the reflector or are non-detachably connected thereto. The adaptor, as described above, is retained in a bayonet-like manner. In this position of the adaptor the connection contacts on the lamp base are in the correct position, in which by means of inserting the plug-in device into the adaptor, a connection to the contact elements arranged in the plug-in device is achieved. The plug-in device is secured in the adaptor only by frictional forces. Additionally, further contacts are provided, closing the low voltage circuit, which serves for activating the lamp circuit. By means of inserting the plug-in device into the adaptor, the contacts on the lamp base are electrically conductively connected to the lamp circuit and simultaneously the additional contacts, closing the low voltage circuit. This means, that the contacts of the plug-in device, coming to contact those on the lamp base, are already during the connection procedure live, carrying a high voltage. This can lead to failures.

SUMMARY OF THE INVENTION

The invention is based on the object, to provide a connector arrangement, in which only then, when the first contact elements and the first counter contact elements are completely connected to each other, i.e. when the first and second connectors are in the completely connected condition, second contact elements are connected to second counter contact elements.

This object is solved by a connector arrangement comprising:

a first connector, which has a housing, which has a first end and a second end, and first accommodation chambers for first contact elements and to which housing (5) first locking means are arranged, has a slider, arranged displaceably on the housing and which forms a receptacle for second contact elements, a second connector, which forms a receptacle for first counter contact elements, which are connected to the first contact elements when connecting the first and second connectors, has second locking means, which engage in the first locking means, when the first and second connectors are completely connected, accommodates second counter contact elements, retaining means, which allow a displacement of the slider such, that the second contact elements arranged thereto contact the second counter contact elements only then, when the first locking means of the housing of the first connector are completely connected to the second locking means on the second connector.

Of advantage in this embodiment is, that a connecting procedure is carried out in two steps. Advantageous is the application of such a connector arrangement in electric circuitries, in which the first contact elements and the first counter contact elements carry a high voltage in the completely connected condition of the first and second connectors, wherein the current flow is only possible after carrying out the connection of the second contact elements to the respective second counter contact elements, which close a corresponding control circuit. In the solution according to the invention it is advantageous, that a short connector arrangement is achieved, as the first contact elements or the first counter contact elements, respectively, do not have to be arranged so far sunk, i.e. distanced from each other, that a contact is prevented. A pre-condition for closing the control circuit by means of connecting the second contact elements to the second counter contact elements is, that the connection of the first and second connectors and especially the first contact elements to the first counter contact elements is already successfully finished. An increased safety for all such connector arrangements is achieved, in which it is necessary because of safety reasons or other reasons, to carry out the connecting step for the first contact elements and the second contact elements to the respective counter contact elements in a time delayed manner.

Furthermore, it is provided, that the slider takes up, before connecting the first and second connectors, a first position relative to the housing, the retaining means comprise first retaining means, arranged on the slider, comprise second retaining means, arranged on the second connector and interact with the first retaining means on the slider and therefore, hold in a non displaceable manner the slider relative to the second connector, till the slider takes up a second position relative to the housing, the first retaining means on the slider and the second retaining means on the second connector are coming out of engagement, when the first locking means of the housing of the first connector are completely connected to the second locking means on the second connector, so that the slider is displaceable from the second position again into the first position and thereby, the second contact elements come to contact the second counter contact elements.

It is provided, that the housing of the first connector forms a first longitudinal axis, the first accommodation chambers for the first contact elements extend parallel to the first longitudinal axis and the slider on the housing can be displaced parallel to the first longitudinal axis. In this case, the second connector forms a second longitudinal axis, wherein the first counter contact elements are aligned parallel to the second longitudinal axis, so that the connecting step of the connectors can be carried out when the first longitudinal axis is aligned to the second longitudinal axis.

In an embodiment of the invention it is provided, that the housing of the first connector has adjustment means, which disengage the first retaining means on the slider from the second retaining means on the second connector.

Further, it is provided, that the second contact elements and the second counter contact elements serve for closing an electrical control signal circuit.

Advantageous is, when the slider is held in the first position. Preferably, the slider is used to secure in the first position, that then, when the first connector is completely connected to the second connector, the locking means are secured against a displacement out of engagement. Thus, an unintended release of the first and second connectors from each other is securely prevented. The slider takes up automatically this position, when it, as additionally provided, is urged by a spring to take up the first position. Initially, the slider has to be moved, to release the locking means. Preferably, the first locking means are represented by an elastic locking arm with a locking hook on the free end of the elastic locking arm. The second locking means are, preferably, represented by a locking projection, engaged behind by the locking hook.

BRIEF DESCRIPTION OF THE DRAWINGS

A preferred embodiment according to the invention is shown schematically in the drawing.

DETAILED DESCRIPTION OF THE INVENTION

Figure 1:
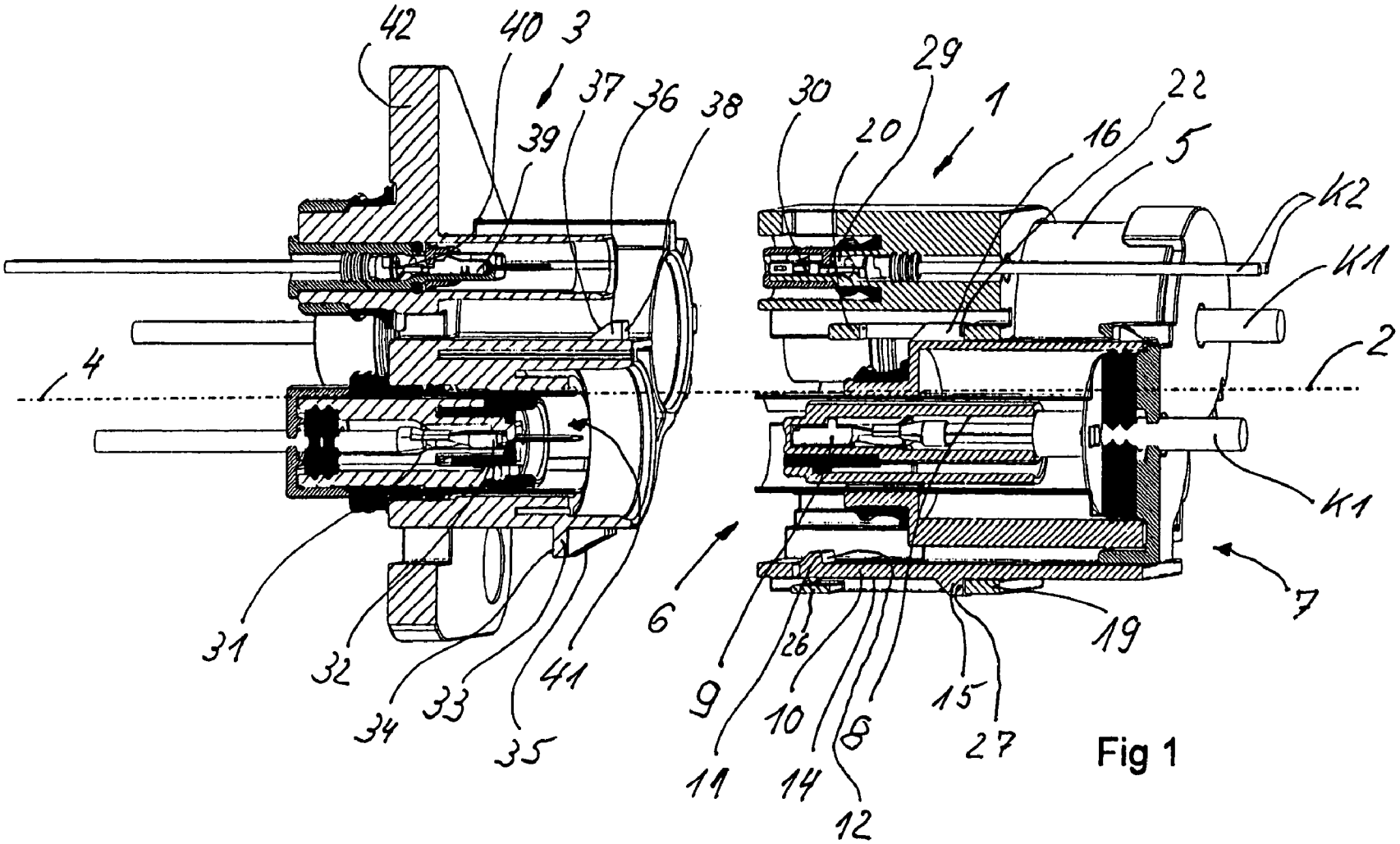
FIG. 1 a longitudinal sectional view of the first and second connectors forming the connector arrangement, before connecting, FIG. 2 a longitudinal sectional view, which shows the beginning of the connecting process of the first and second connectors, FIG. 3 a longitudinal sectional view, in which the connecting of the first and second connectors has advanced compared to the situation of FIG. 2, FIG. 4 a longitudinal sectional view through the first and second connectors, wherein the locking of the first and second connectors relative to each other is carried out and the release of the slider from the second position has started, FIG. 5 a longitudinal sectional view through the first and second connectors in the final connection position, wherein also the slider is returned completely into the first position and, thus, the second contact elements and the corresponding second counter contact elements are connected, FIG. 6 a detail concerning the locking means for locking the first and second connectors in the completely connected condition concerning the relative positioning to each other, FIG. 7 as a detail the corresponding position or relative positioning of the retaining means on the slider and on the second connector in the completely connected condition, and FIG. 8 a perspective view of the first connector 1, partially in a sectional view.
Figure 7:
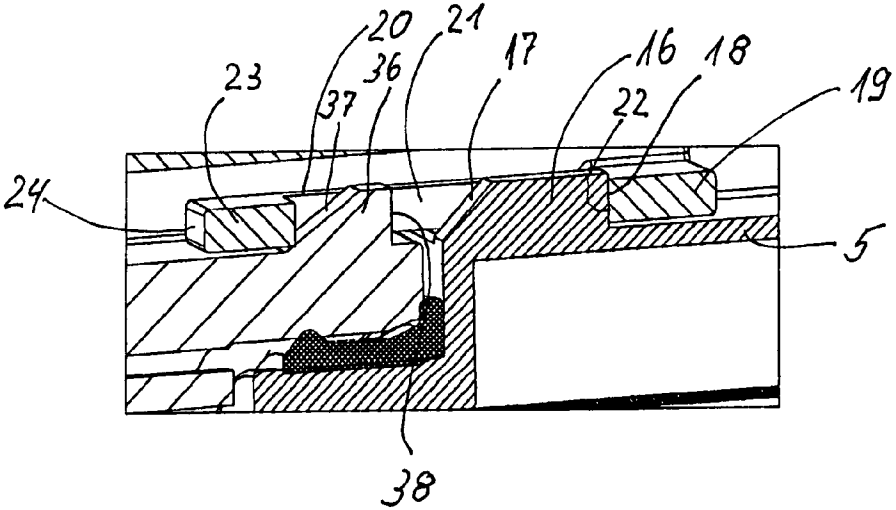
Figure 6:
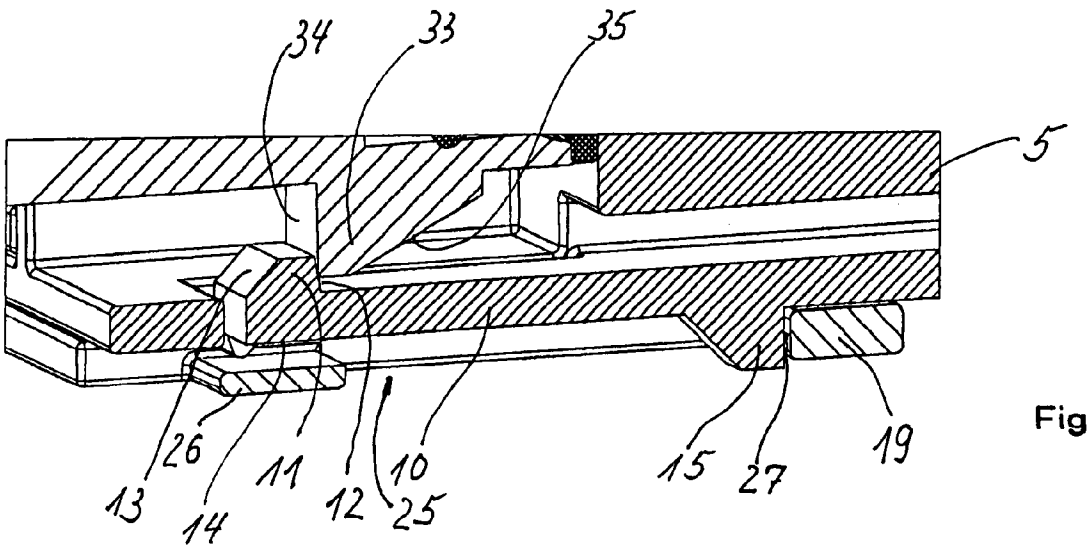

Firstly, a description of the first and second connectors by means of FIG. 1 as well as in relation to the details by considering FIGS. 6 and 7, in which this detail of FIG. 1 is shown enlarged, is given.

The connector arrangement according to the invention comprises a first connector 1, forming a first longitudinal axis 2, and a second connector 3 (herein after also jointly referred to as the two connectors), forming a second longitudinal axis 4. The connecting of the two connectors 1, 3 is carried out when the two longitudinal axes 2, 4 are aligned to each other, i.e. these are moved towards each other along the longitudinal axes 2, 4 for the connecting procedure and away from each other for detaching.

The first connector 1 comprises a housing 5, made from an electrically insulating material, e.g. resin material, which for example can be made from a multiplicity of parts, to facilitate the assembly of contact elements.

For facilitating the explanation of the position of the components relative to each other, forming the first connector 1, it is defined, that the left end of the housing 5 shown in FIG. 1, represents the first end 6 and the right end of the housing 5 shown in FIG. 1 represents the second end 7, wherein these ends do not define a specific edge.

Parallel to the first longitudinal axis 2, in the housing 5, first accommodation chambers 8 are provided, in which first contact elements 9, in this embodiment in form of female contact terminals, are accommodated. In the embodiment two such first accommodation chambers 8 with first contact elements 9 are provided. The first accommodation chambers 8 extend parallel to the first longitudinal axis 2. To the first contact elements 9, retained in the first accommodation chambers 8, first cables K1 are electrically conductively connected, which are lead at the second end 7 out of the housing 5 and form, for example, part of the wire harness of an automotive vehicle.

To the housing 5, first locking means, for example in form of a locking arm 10, are arranged. This locking arm 10 is easier to see in the representation of FIG. 6. The locking arm 10 extends essentially parallel to the first longitudinal axis 2 and with its end facing the second end 7 is formed unitarily with the housing 5. The portion extending in direction towards the first end 6 is not connected to the housing 5, so that an elastic deflection of the locking arm 10 can be carried out. This supports on its end facing the first end 6 a hook 11 projecting in direction towards the first longitudinal axis 2 and having in the direction towards the second end 7 a locking face 12 and in direction towards the first end 6 an adjustment face 13. The locking face 12 and the adjustment face 13 are formed inclined towards the longitudinal axis 2, wherein the locking face 12 forms with the first longitudinal axis 2 in direction towards the second and 7 an angle, which is larger than the angle, which is formed by the adjustment face 13 with the first longitudinal axis 2 in direction towards the first end 6. This means, that the locking face 12 extends relatively steep.

The outer face of the locking arm 10 is designated with the reference numeral 14. Furthermore, the housing 5 supports close to the end of the locking arm 10 connected to the housing 5, an abutment 15 facing away from the first longitudinal axis 2. Away from the first longitudinal axis 2 in relation to the locking arm 10 an adjustment projection 16 is formed off-set upwards on the housing 5, which has on its end facing to the first end 6 an adjustment face 17, which forms together with the first longitudinal axis 2 an acute angle which opens in the direction towards the second end 7. On its end distanced to the adjustment face 17 the adjustment projection 16 is provided with an abutment face 18 extending perpendicularly to the first longitudinal axis 2.

On the housing 5, a slider is displaceably guided along the first longitudinal axis 2 from a first position, in which it approaches the first end 6, into a second position, in which it is displaced in the direction towards the second end 7. The guides are not represented in detail.

Figure 8:
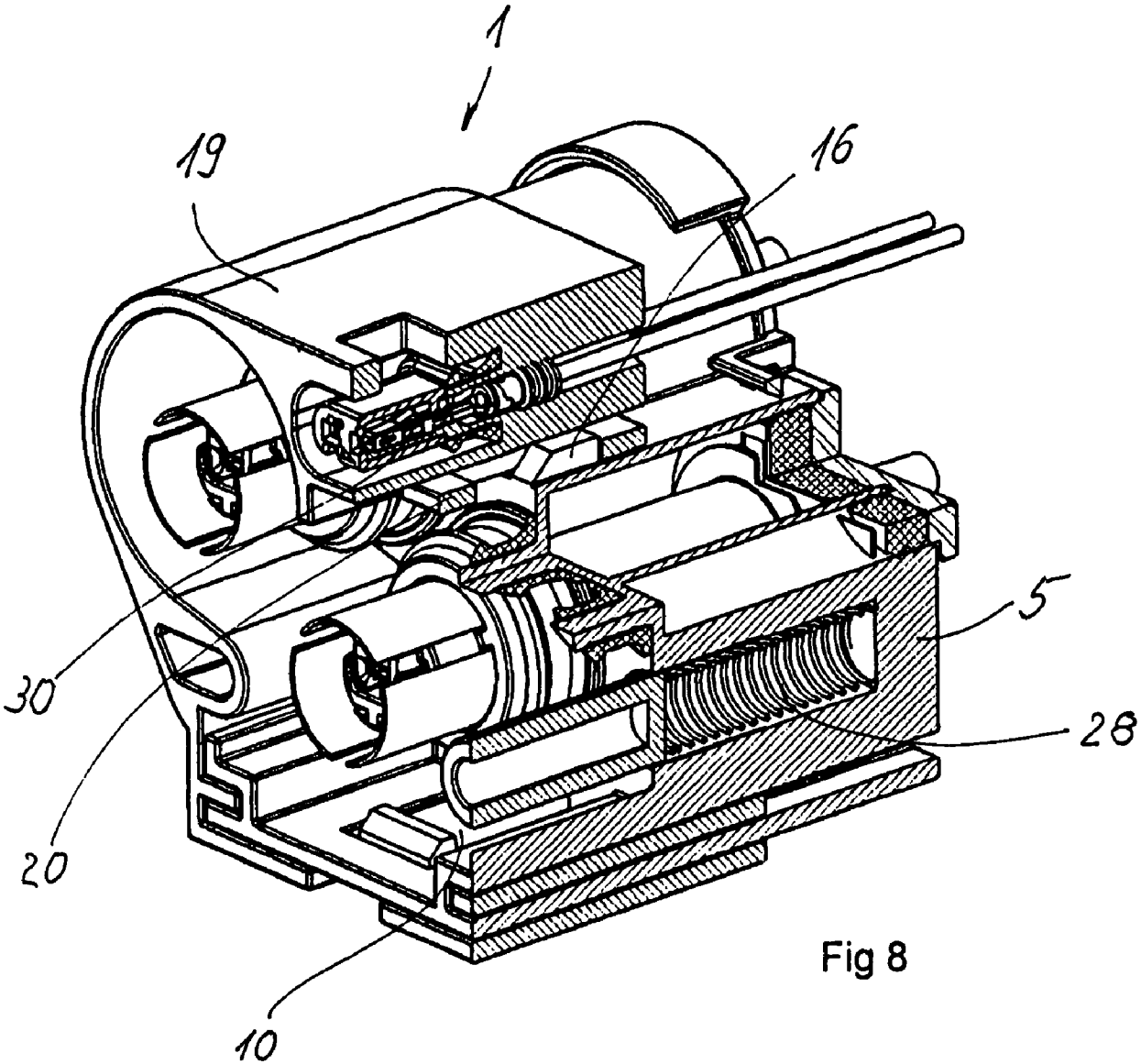

The slider 19 is acted upon by two springs 28 arranged parallel to the longitudinal axis and of which only one is visible in FIG. 8, to take up the first position close to the first end 6. The springs 28 are supported on the housing 5 and further on the slider 19. The movement of the slider 19 in direction towards the advanced first position is limited by an abutment face 22, which is provided in a first through opening 21 of a retaining arm 20 formed unitarily with the slider 19 and in which it is supported on the abutment face 18 on the adjustment projection 16 of the housing 5. The retaining arm 20 forms first retaining means and is formed frame-like, wherein two longitudinal webs are provided, which at the end of the first through opening 21, having the abutment face 22, are unitarily connected to the wall of the slider 19. The free ends of the longitudinal webs are connected by a retaining web 23 extending cross-wise thereto. This retaining web 23 has at its end facing in the direction towards the first end 6 a first retaining face 24.

A further retaining of the slider 19 in its advanced, i.e. in the position close to the first end 6, is achieved by abutment of the counter abutment 27 of the slider in the area of the second through opening 25 on the abutment 15 of the housing 5.

The end of the second through opening 25 of the slider 19 facing the first end 6 is limited by a securing web 26, which, as especially visible from FIG. 6, in the completely connected condition of the two connectors 1, 3 is arranged opposed to the outer face 14 of the locking arm 10 in the area of the hook 11 and, thus, limits a deflection of the locking arm 10.

The slider 19 (made from an electrically insulating resin material) has, furthermore, as especially visible from FIGS. 1 and 8, a receptacle 29, in which two second contact elements 30 are arranged, which, for example, are electrically conductively connected to cables K2, wherein the cables K2 represent signal lines, which transmit signals of the connection condition of the connector arrangement.

The second connector 3, shown in FIG. 1, has two receptacles 31, extending parallel to the second longitudinal axis 4, which, respectively, accommodate a first counter contact element 32 for the first contact elements 9. In the present embodiment the first counter contact elements 32 are formed as male terminals, which are connected via corresponding connection portions to cables, which, respectively, are electrically conductively connected to the cables K1. These first counter contact elements 32 formed as male terminals project into an insertion chamber 41. Into this, the corresponding portions of the housing 5 accommodating the first contact elements 9 are inserted. The receptacles 31 for the two provided first counter contact elements 32 can belong to portions of the second connector 3 separate from each other. Correspondingly, also, the portions of the housing 5 of the first connector 1, insertable into the respective insertion chamber 41, are housing portions, separate from each other.

For locking the two connectors 1, 3 to each other, a locking projection 33 serves as second locking means, which projects away from the second longitudinal axis 4 and which is arranged opposed to the hook 11 of the locking arm 10 of the first connector 1 during connecting. It has an adjustment face 35 facing the first adjustment face 13 of the locking arm 10 and which during the connecting process deflects the locking arm 10. It has, furthermore, a locking face 34, extending at a right angle to the second longitudinal axis 4 and which, in the completely connected condition of the two connectors 1, 3, interacts with the locking face 12 of the hook 11.

Furthermore, the second connector 3 comprises a retaining projection 36 as second retaining means, which projects away from the second longitudinal axis 4 and comprises a detaching face 37, which serves for lifting the retaining arm 20 during the detaching process of the two connectors 1, 3 from each other. For this, the detaching face 37 acts onto the edge of the retaining web 23, belonging to the face, limiting the first through opening 21 in direction towards the first end 6. Furthermore, the retaining projection 36 comprises a second retaining face 38, facing during the connecting process of the two connectors 1, 3 to each other in the direction towards the first end 6 of the first connector 1 and extending essentially perpendicularly to the second longitudinal axis 4.

Finally, the second connector 3 has accommodation chambers 40, extending parallel to the longitudinal axis, for second counter contact elements 39 which are, also, formed as male terminals. These interact with the second contact elements 30 formed as female terminals and attached on the slider 19, i.e. can be connected to these, to connect the cables K2 to the corresponding cables connected to the second counter contact elements 39 for closing, for example, an electric control circuit. The second connector 3 comprises, further, a flange 42 for fixing on a housing or a similar stationary component.

Following the steps for connecting and detaching the two connectors 1, 3 are described in detail, starting from the position, which they take up in FIG. 1, i.e. in which they are separated from each other, by means of the further Figures.

Figure 2:
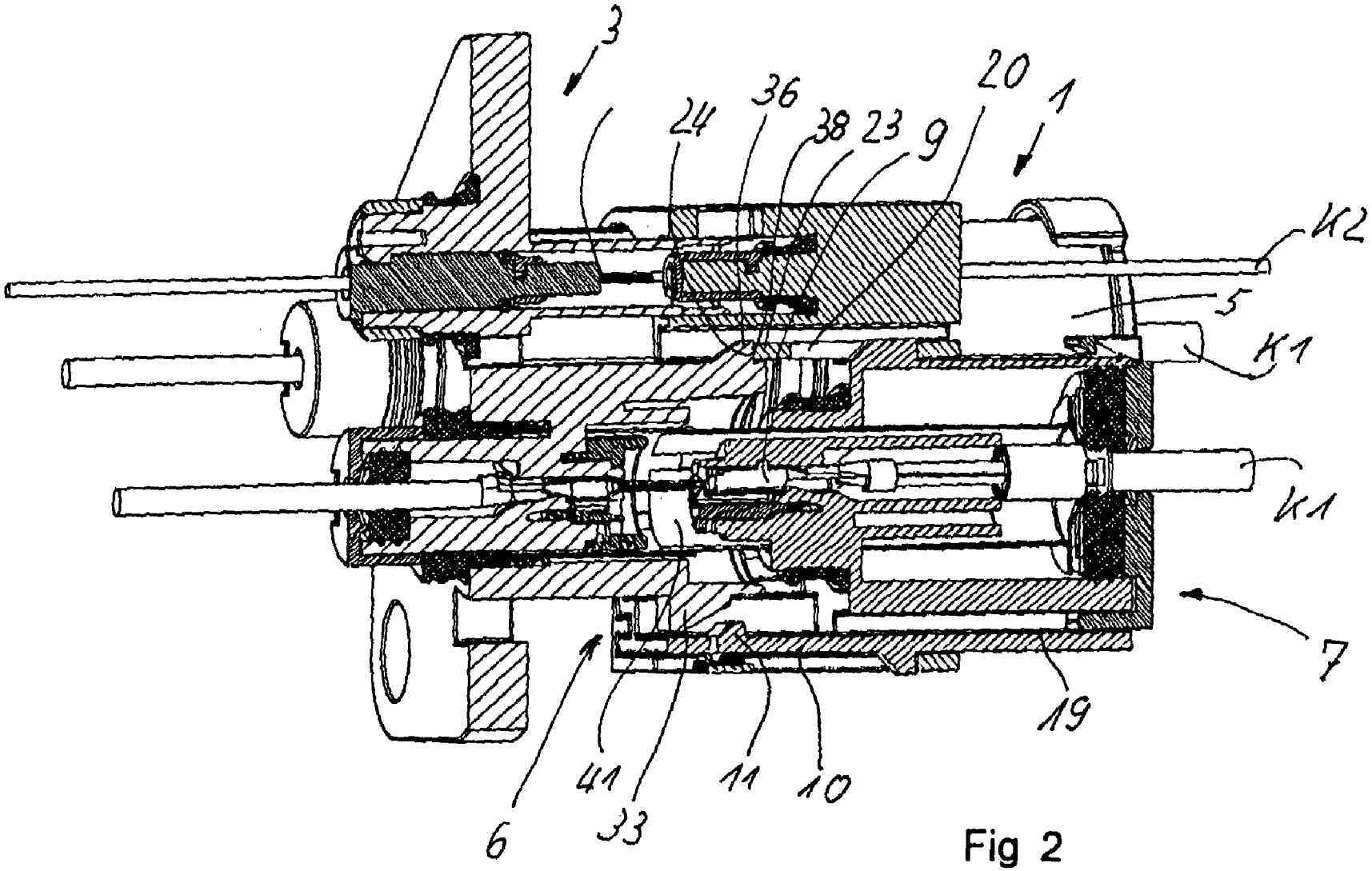

Starting from FIG. 1, after aligning the two longitudinal axes 2, 4 of the two connectors 1, 3 relative to each other, a moving towards each other of the same is carried out, so that the portions of the housing 5, having the first contact elements 9, enter into the respectively mating insertion chamber 41. The slider 19 takes up its first position, in which it is approaching the first end 6. When inserting, as visible from FIG. 2, the retaining arm 20 contacts with the first retaining face 24 of its retaining web 23 the second retaining face 38 of the retaining projection 36 of the second connector 3 and is supported on the same.

Figure 3:
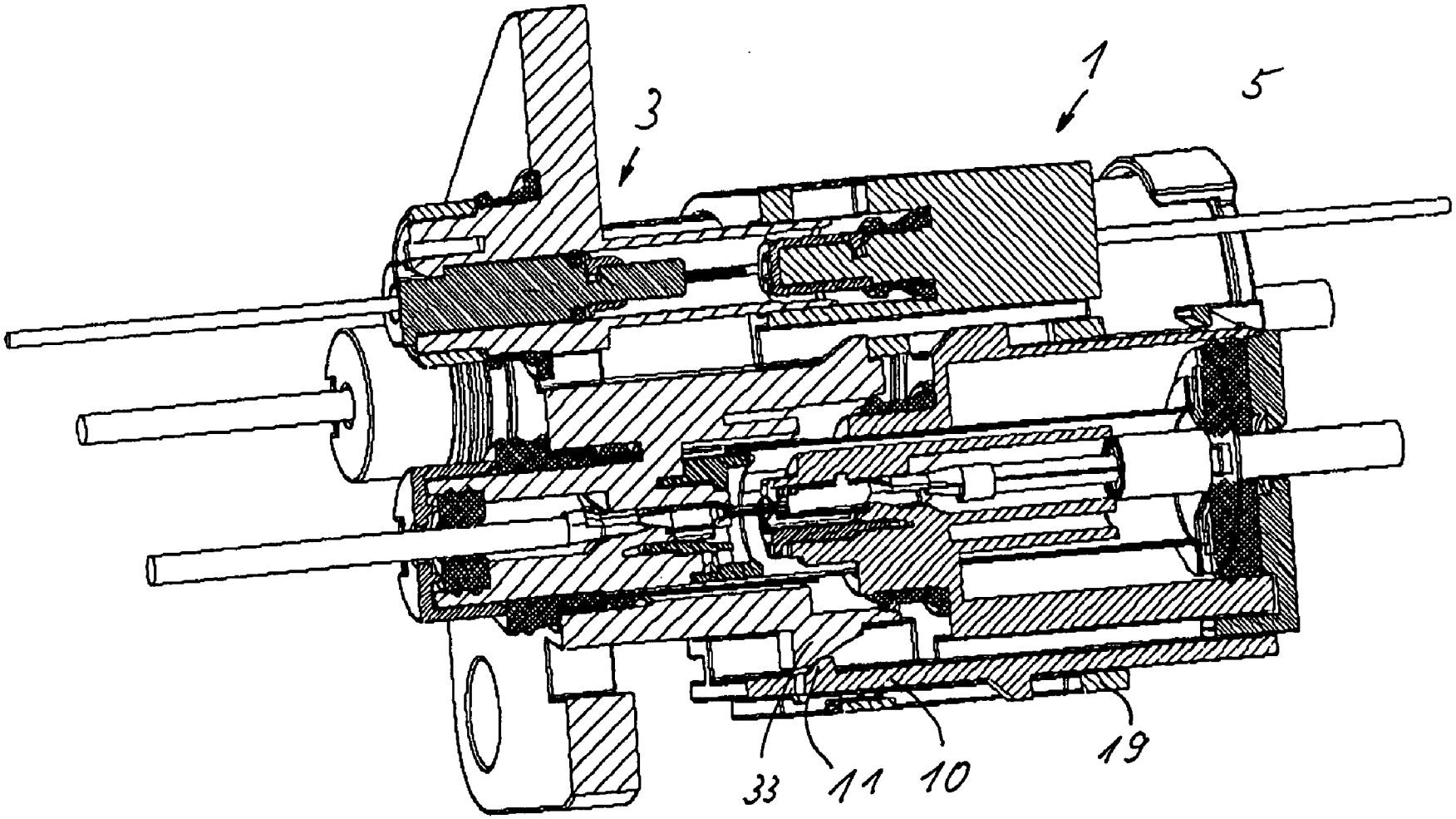
Figure 4:
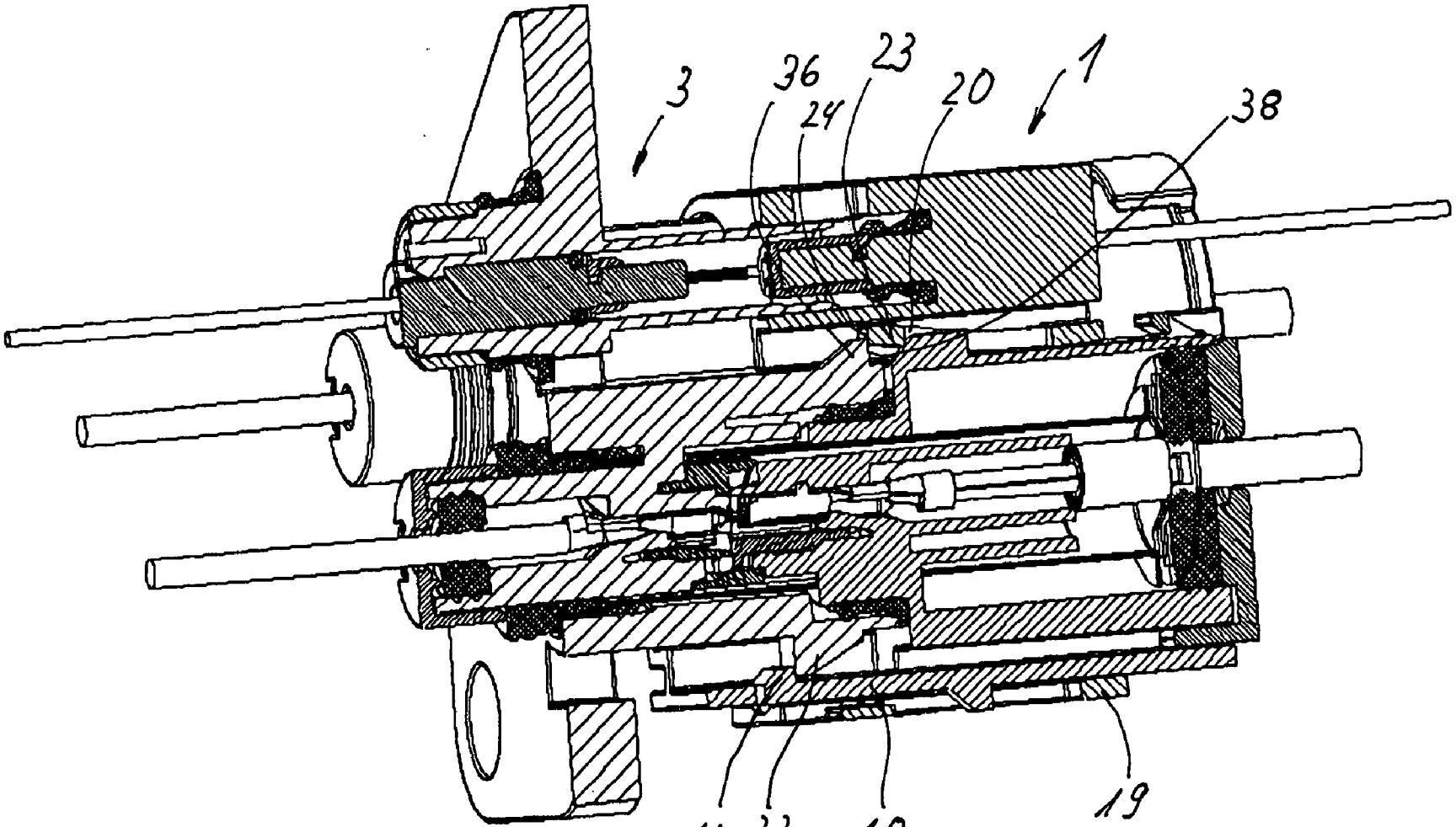

When further inserting or connecting the two connectors 1, 3, respectively, the slider 19 remains in position, as it is supported via the retaining arm 20 and the first retaining face 24 on the second retaining face 38 of the retaining projection 36, so that the slider 19 cannot carry out a relative movement relative to the second connector 3, but compared to the movement of the housing 5 towards the flange 42 of the second connector 3 lags behind. It does not participate in this movement. During this movement of the housing 5 the hook 11 of the locking arm 10 comes into abutment with its adjustment face 13 to the adjustment face 35 of the locking projection 33 (see FIG. 3), so that during further insertion of the housing 5 in direction towards the flange 42, the locking arm 10 of the housing 5 is elastically deflected outward from the longitudinal axes 2, 4 aligned to each other. During this, the locking arm 10 can escape outward away from the longitudinal axes 2, 4, as it is not prevented therefrom by the slider 19. When further connecting the two connectors 1, 3 a position is reached, in which the hook 11 of the locking arm 10 has passed the locking projection 33 and engages behind the same, as it is visible from FIGS. 4 and 6. Due to this, the hook 11 gets behind the locking projection 33 in the area of the locking face 34. Simultaneously in this movement the retaining arm 20 is elastically deflected away from the longitudinal axes 2, 4, aligned to each other, with its retaining web 23. This results from the fact, that the adjustment projection 16 of the housing 5, especially visible in more detail from FIG. 7, acts, during the movement with its adjustment face 17, onto the edge of the retaining web 23 between its lower face and its limiting face facing the through opening 21. The retaining web 23 is, thus, lifted so far, that it can get passed the retaining projection 36, so that it gets onto the detaching face 37 during the further connection of the two connectors 1, 3. Resulting from this, the retaining arm 20 again takes up its relaxed initial position. When the retaining web 23 is acted upon by the adjustment face 17 of the adjustment projection 16, the retaining web 23 with its first retaining face 24 comes out of abutment from the second retaining face 38 of the retaining projection 36.

Figure 5:
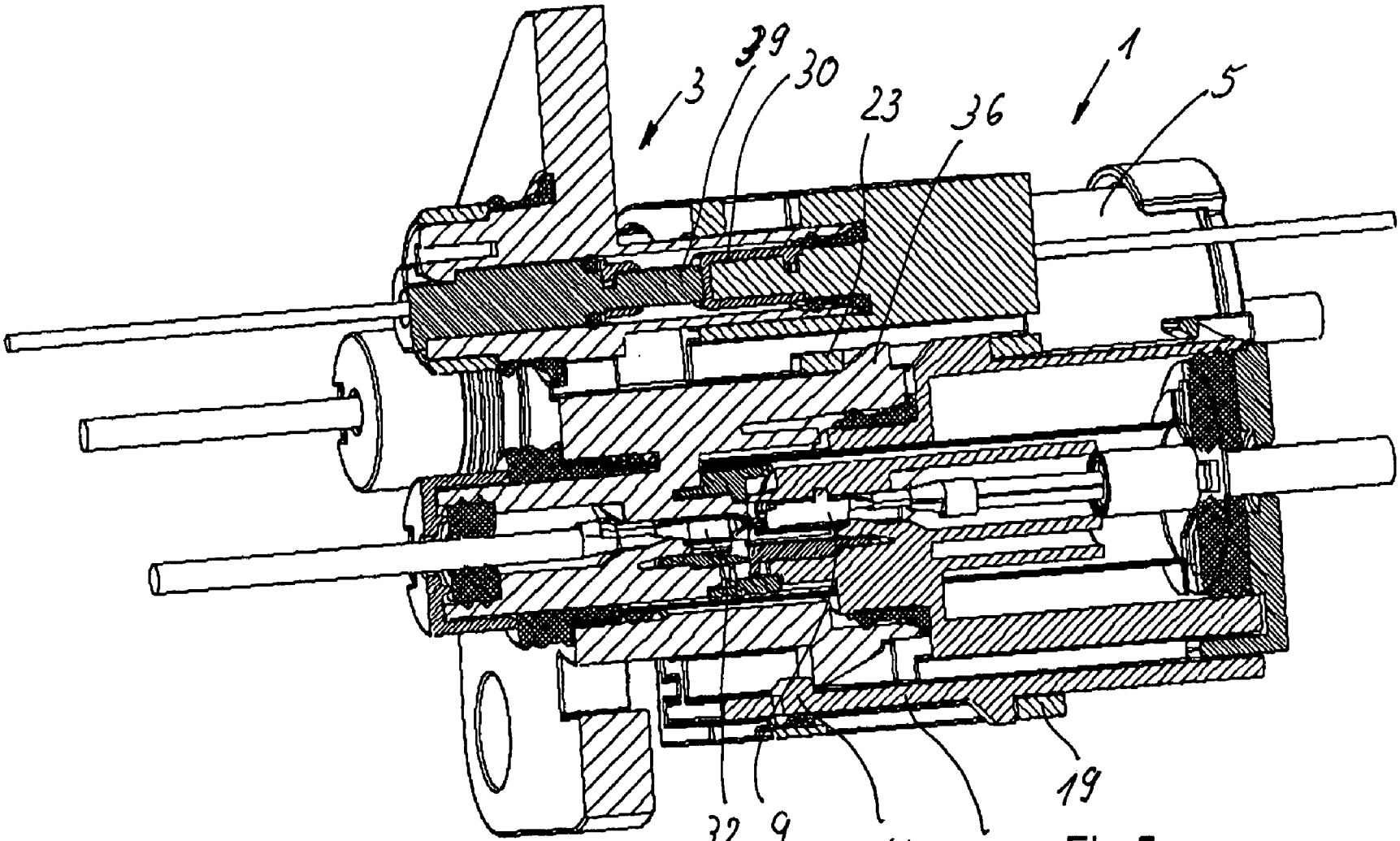

Therefore, a position is reached, in which the two first contact elements 9 and the first counter contact elements 32 are completely connected to each other (FIG. 5), but a current flow is still not possible.

Due to this movement, the springs 28 become simultaneously active, so that the slider 19 is released from its second position, in which it is still supported via its retaining arm 20 on the second connector 3 and which it takes up, relative to the housing 5 of the first connector 1, and returns to its first position relative to the first connector 1, in which the slider 19 is arranged close to the first end 6. Thus, the second contact elements 30 are simultaneously connected in an electrically conductive manner to the second counter contact elements 39. As, hereby, the signal lines are connected to each other, it is signalled, that the first contact elements 9 and the first counter contact elements 32 are effectively connected to each other. Now, a switching-on of the current for the current supply between the first contact element and the first counter contact element can be carried out or activated. During the movement of the slider 19 to its first position, i.e. in the connected condition in direction towards the flange 42 because of the springs 28, the securing web 26 is also moved passing the hook 11 of the locking arm 10, so that no unintended detaching is produced, as the hook 11, even when pulling the housing 5 or, thus, the cable K1, connected thereto, cannot deviate.

For detaching one has to act by hand in a pulling manner onto the slider 19, such that the slider is moved along the longitudinal axes 2, 4 away from the flange 42 into its second position. Thus, the securing web 26 is moved out of its position arranged opposed to the hook 11 and the second contact elements 30 are separated from the second counter contact elements 39. Thus, it is signalled, that, for example, the current circuit, to which the cables K2 and the first contact elements 9 and the first counter contact elements 32 belong, can be interrupted by a control current circuit.

When further pulling, the locking arm 10 is elastically deflected because of the contour of the locking face 12 relative to the locking face 34, so that the hook 11 gets passed the locking projection 33 and, when further pulling, the first contact elements 9 can be separated from the first counter contact elements 32. Finally, a position is taken up, as it is shown in FIG. 1.

What is claimed is:

1. Connector arrangement comprising:

a first connector (1), which has a housing (5), having a first end (6) and a second end (7), first accommodation chambers (8) for first contact elements (9), first locking means (10), and a slider (19), arranged displaceably on the housing (5) and which forms a receptacle (29) for second contact elements (30);

a second connector (3), forming a receptacle (31) for first counter contact elements (32), which are connected to the first contact elements (9) when connecting the first and second connectors (1,3), the second connector having second locking means (33), which engage in the first locking means (10), when the first and second connectors (1, 3) are completely connected, and the second connector accommodating second counter contact elements (39); and retaining means (20, 36), which allow a displacement of the slider (19) such that the second contact elements (30) arranged thereto contact second counter contact elements (34) only when the first locking means (10) of the housing (5) of the first connector (1) are completely connected to the second locking means (33) on the second connector (3), wherein the slider (19) takes up, before connecting the first and second connectors (1, 3), a first position relative to the housing (5), and the retaining means (20, 36) comprising:

first retaining means (20), arranged on the slider (19), and second retaining means (36), arranged on the second connector (3) to interact with the first retaining means (20) on the slider (19) and therefore, hold in a non displaceable manner the slider (19) relative to the second connector (3), until the slider (19) takes up a second position relative to the housing (5), wherein, the first retaining means (20) on the slider (19) and the second retaining means (36) on the second connector (3) come out of engagement when the first locking means (10) of the housing (5) of the first connector (1) is completely connected to the second locking means (33) on the second connector (3), so that the slider (19) is displaceable from the second position again into the first position and thereby, the second contact elements (30) come to contact the second counter contact elements (34).

2. Connector arrangement according to claim 1, wherein the housing (5) of the first connector (1) forms a first longitudinal axis (2), the first accommodation chambers (8) for the first contact elements (9) extend parallel to the first longitudinal axis (2) and the slider (19) on the housing (5) can be displaced parallel to the first longitudinal axis (2).

3. Connector arrangement according to claim 1, wherein the second connector (3) forms a second longitudinal axis (4) and that the first counter contact elements (32) are aligned parallel to the second longitudinal axis (4).

4. Connector arrangement according to claim 2 wherein the connecting of the first and second connectors (1, 3) is carried out when the first longitudinal axis (2) is aligned to the second longitudinal axis (4).

5. Connector arrangement according to claim 1, wherein the housing (5) of the first connector (1) has adjustment means (15), which disengage the first retaining means (20) on the slider (19) from the second retaining means (36) on the second connector (3).

6. Connector arrangement according to claim 1, wherein the second contact elements (30) and the second counter contact elements (39) serve for closing an electrical control signal circuit.

7. Connector arrangement according to claim 1, wherein the slider (19) is held in the first position.

8. Connector arrangement according to claim 7, wherein the slider (19) is acted upon by at least one spring (28) to take up and maintain the first position.

9. Connector arrangement according to claim 7, wherein the slider (19) in its first position secures the first locking means (10) retaining the first connector (1) with the second connector (3) in the completely connected position, against a displacement out of engagement with the second locking means (33).

10. Connector arrangement according to claim 1, wherein the first locking means (10) is represented by an elastic locking arm with a locking hook (11) and the second locking means (33) is represented by a locking projection, which is engaged behind by the locking hook (11).

* * * * *